US006582098B1

(12) United States Patent
Brown et al.

(10) Patent No.: US 6,582,098 B1
(45) Date of Patent: Jun. 24, 2003

(54) PARABOLIC LOUVER AND SIDE LIGHT SEAL

(76) Inventors: Raymond A. Brown, 3220 S. Whipple Ct., Spokane, WA (US) 99208; Paul Custer, 1101 N. 11$^{th}$, Coeur d'Alene, ID (US) 83814; James A. Rigley, 6800 N. Radcliffe St., Bristol, PA (US) 19007

( * ) Notice: Subject to any disclaimer, the term of this patent is extended or adjusted under 35 U.S.C. 154(b) by 0 days.

(21) Appl. No.: 09/711,070

(22) Filed: Nov. 14, 2000

(51) Int. Cl.$^{7}$ ..... F21V 11/02; F21V 11/06
(52) U.S. Cl. ..... 362/291; 362/354; 362/396
(58) Field of Search ..... 362/291, 290, 362/279, 396, 436, 342, 325, 292, 354

(56) References Cited

U.S. PATENT DOCUMENTS 4,175,281 A 11/1979 Lonseth
4,268,897 A 5/1981 Schierwagen et al.
4,613,929 A 9/1986 Totten
4,780,800 A * 10/1988 Mullins ..... 362/342
4,839,778 A 6/1989 Wall, Jr.
4,849,867 A 7/1989 Glass et al.
5,806,972 A 9/1998 Kaiser et al.
5,823,663 A * 10/1998 Bell et al. ..... 362/362

FOREIGN PATENT DOCUMENTS

JP 4-322005 * 11/1992

* cited by examiner

*Primary Examiner*—Sandra O'Shea
*Assistant Examiner*—Bao Q. Truong
(74) *Attorney, Agent, or Firm*—Hunton & Williams

(57) ABSTRACT

A parabolic louver and side light seal are disclosed for use in an overhead lighting system. The parabolic louver comprises a series of ultra-thin, lightweight stringers and baffles arranged perpendicular to one another and securely connected via "snap-fit" side and center joints. The side light seal comprises two side rails and two end rails. The two side rails are mounted to the sides of the parabolic louver to reinforce the louver, to provide a light seal, and to precisely locate the louver below the light source.

20 Claims, 8 Drawing Sheets

PARABOLIC LOUVER AND SIDE LIGHT SEAL

BACKGROUND OF THE INVENTION

1. Field of the Invention

The field of this invention relates generally to lighting fixtures, and more particularly to a parabolic louver and side light seal for use therein.

2. Description of Related Art

Overhead lighting systems have long been used to illuminate office, commercial, institutional, and industrial spaces. Such systems are commonly found in buildings that utilize "dropped ceilings" which are hung from the floor platforms of the story located immediately above. Overhead lighting systems typically comprise a light fixture housing, or troffer. Troffers are conventionally designed in the shape of shallow, inverted, rectangular boxes having one open face. A series of light fixture housings or troffers are usually installed in a dropped ceiling, with each troffer carrying at least one tubular fluorescent lamp, HID lamp, or incandescent lamp therein, to serve as the light source.

Oftentimes, a transparent or translucent lens may be used to cover the open face of the light fixture housing. Such lenses are undesirable because they do not effectively prevent the escape of low angle light rays from the light fixture housings. These low angle light rays may create a glare that can be irritating to those individuals located in the space that the overhead lighting systems are designed to illuminate.

Accordingly, there have been several proposed solutions for eliminating or minimizing glare.

Coffers, for instance, are rectangular recesses formed in a ceiling at spaced intervals that are designed to house the light fixture housings. In order for a coffer to effectively reduce glare, it must have deeper dimensions than the light fixture housings that it will contain. This is because light fixture housings are usually installed in the upper surface or wall of the coffer, allowing the remaining side walls of the coffer to act as barriers to escaping low angle light rays. Though generally effective in reducing glare, coffers are often costly to install, and in certain instances, coffers may be impossible to install if the architectural design of the building prevents it.

One preferred method for reducing glare has been to direct the light radiating from a troffer downward using a louver. A louver is a grid-like structure comprising a series of blades (or baffles) arranged perpendicular to one another and interlocked to form a series of more or less equally sized square or rectangular openings. A louver is typically mounted directly beneath the lighting tubes of light fixture housings, or troffers, such that the bottom edge of the louver is more or less flush with the plane of the ceiling. A louver is typically assembled from a series of lateral and longitudinal metal blades. It has also been known to fabricate single-piece, plastic louvers using conventional injection molding techniques. Plastic louvers may be undesirable, however, because of deterioration that can result when lamps that generate substantial amounts of heat are used, such as HID or incandescent lamps. Whether metal or plastic, the blades of most louvers are designed with parabolic side wall surfaces. These surfaces are shaped to reflect the light emitted from the lamps downward, thus avoiding the escape of the low angle light rays which produce glare.

In addition to a louver and a light fixture housing, some overhead lighting systems also include a light trap or light seal device. A conventional light trap device typically includes a pair of side rails and a pair of end rails which, in combination, form a substantially rectangular light trap that is disposed between the light fixture housing and the edges of the louver. The light trap serves to prevent the escape or "leakage" of any light from around the peripheral edges of the louver.

Examples of prior art louvers are illustrated in U.S. Pat. Nos. 4,268,897 and 4,849,867.

In U.S. Pat. No. 4,268,897 to Schierwagen et al., a louver for a lighting fixture is disclosed having a plurality of longitudinally-extending light baffles which are aligned at right angles to a plurality of transversely-extending light baffles. In order to assemble the louver, camming projections on the top wall sections of the transverse baffles engage deflectable tongues formed on the side wall surfaces of the longitudinal baffles. Additionally, slots are cut-out in each side wall of the longitudinal baffles, and locking apertures are cut-out in the top wall sections of the longitudinal baffles in order to facilitate the "snap-in" engagement of the two baffles. Having a longitudinal baffle with slots in the side walls and apertures in the top walls may be disadvantageous, as a more elaborate and costly machining and assembly process may be necessary as compared to baffles that simply have openings in a side wall only.

U.S. Pat. No. 4,849,867 to Glass et al., also discloses a louver for a light fixture comprising a plurality of longitudinally extending blades interconnected with a plurality of transversely extending blades. The louver is assembled by sliding the transversely extending blades into corresponding notches in the longitudinally extending blades. As a result of being joined together in this manner, the ends of the longitudinally extending blades protrude outward along the periphery of the two sides of the louver, while the ends of the transversely extending blades protrude outward along the periphery of the two ends of the louver. This is best illustrated in FIGS. 1 and 2 of the '867 Patent. Since the entire outer periphery of the louver contains the protruding ends of the transverse and longitudinal blades, it would be difficult to add a substantially rectangular light trap that can sit in abutment against the peripheral edges of the louver. A more elaborate light trap would have to be designed that could surround the periphery of the louver while simultaneously accounting for the protruding ends of the blades.

It is these deficiencies, among others, that the invention of the preferred embodiments has overcome.

SUMMARY OF THE INVENTION

In response to the difficulties encountered in the prior art, a parabolic louver and side light seal are disclosed for use in an overhead lighting system. The parabolic louver and side light seal are disposed within a light fixture housing, just below one or more tubular lamps. The parabolic louver focuses the light radiated from the tubular lamps in a downward direction, while the side light seal, disposed around the outer periphery of the parabolic louver, prevents light rays from escaping in the space between the light fixture housing and parabolic louver.

A series of ultra-thin, lightweight aluminum stringers and baffles arranged perpendicular to one another comprise the parabolic louver. The stringers extend in the longitudinal direction, while the baffles extend in the transverse direction. Novel side and center joints provide the means by which the longitudinal stringers and transverse baffles are interconnected in a quick, easy, and secure manner, to form the parabolic louver.

With the exception of two side stringers and two end baffles that define the respective sides and ends of the louver, the stringers and baffles each have a generally "V-shaped" cross-section, with parabolic side wall surfaces designed to reflect light. The two side stringers and end baffles that form the outer periphery of the parabolic louver are designed having a curved side wall that extends upward from a base portion and terminates in an upper edge. The base portion of the two side stringers contains a curved lip portion that defines a channel for receiving and securing two side rails of a side light seal.

Various side light seal rail designs, together with the design of the side stringers, allow the two side rails of the side light seal to be mounted to the outer periphery of the parabolic louver. Since the rails of the side light seal are preferably made from steel, mounting them to the periphery of the louver has the effect of reinforcing the parabolic louver.

One advantage of the invention is the ability to provide a durable, lightweight, parabolic louver comprised of ultra-thin stringers and baffles. The stringers and baffles are preferably formed from anodized aluminum, resulting in a finish that increases resistance to dents and scratches while virtually eliminating any visibility of fingerprints or construction dust. Another advantage of the invention is that the baffles and stringers are interconnected via novel "snap-together" side and center joints. These joints allow the parabolic louver to be assembled in a quick and convenient, yet secure manner. The ease with which the stringers and baffles are manufactured and assembled facilitates the creation of various-sized louvers. The number and size of the longitudinal stringers and transverse baffles that comprise the louver can simply be varied in order to vary the number of cells in a louver for appearance and performance considerations, as well as to accommodate light fixture housings of differing size.

Yet another advantage of the invention is the ability to mount the side rails of a side light seal on the side stringers of the louver. The side light seal not only prevents light rays from escaping in the space between the light fixture housing and parabolic louver, but it also has the effect of reinforcing the parabolic louver. The side light seal may also be incorporated with mechanisms which not only prevent the baffles and stringers from separating, but also position the baffles and stringers precisely with respect to the light source.

These and other objects, features and advantages of the invention will be apparent through the detailed description of the preferred embodiments and the drawings attached hereto. It is also to be understood that both the foregoing general description and the following detailed description are exemplary and explanatory and not restrictive of the scope of the invention.

BRIEF DESCRIPTION OF THE DRAWINGS

The invention will be described with respect to the accompanying drawings, in which like elements are referenced with like numbers.

DETAILED DESCRIPTION OF THE PREFERRED EMBODIMENTS

A parabolic louver and side light seal are disclosed for use with an overhead lighting system in order to greatly reduce glare when illuminating commercial, office, institutional, or industrial spaces. It should be recognized that the term "light fixture housing" may be used interchangeably throughout the specification with troffer, light fixture, light housing, fixture, luminaire, or housing, as is known in the art. Similarly, the term "light side seal" may be referred to as a light trap, as is also understood by those having ordinary skill in the art.

Figure 1:
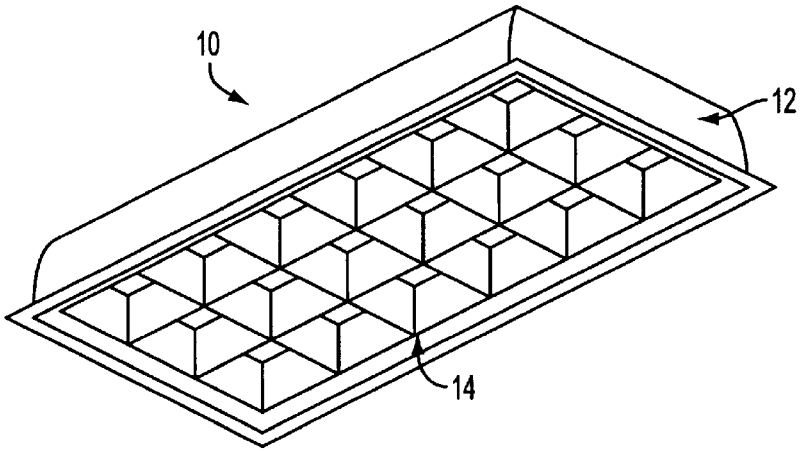
FIG. 1 is a perspective view of a parabolic louver disposed within a light fixture housing according to an embodiment of the invention.
Figure 2:
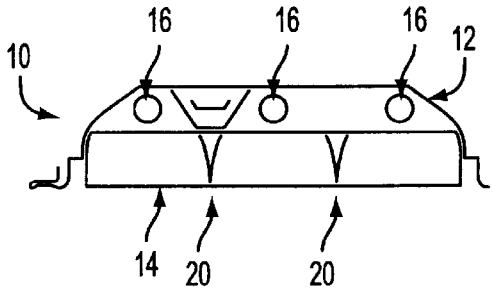
FIG. 2 is a front sectional view of the embodiment illustrated in FIG. 1.

Referring now to the drawings, and in particular to FIGS. 1–2, a parabolic louver 14 is mounted within a conventional light fixture housing 12, such that the bottom edges of both the louver 14 and the fixture 12 are more or less flush with one another, as well as with the plane of a ceiling (not shown). Three tubular fluorescent lamps 16 are disposed between the housing 12 and the louver 14, however, incandescent or HID lamps may also be used, as is known in the art.

Figure 3:
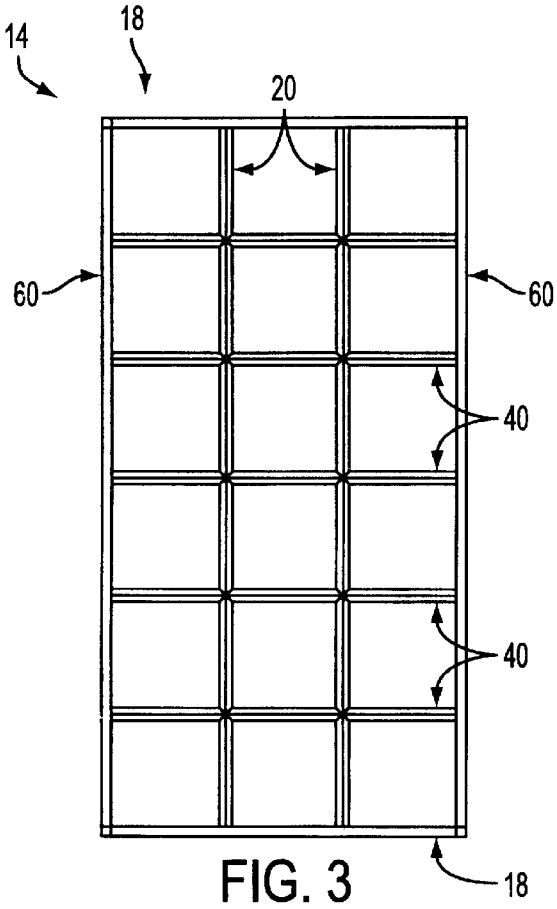
FIG. 3 is a bottom view of a parabolic louver according to an embodiment of the invention.

Parabolic louver 14 comprises a series of stringers and baffles arranged perpendicular to one another to form a series of more or less equally-sized square or rectangular openings. In the embodiment illustrated in FIG. 3, parabolic louver 14 is formed by assembling two side stringers 60 and two center stringers 20 that extend in the longitudinal direction, with two end baffles 18 and five center baffles 40 that extend in the transverse direction. The end baffles 18 and center baffles 40 are preferably about 24 inches in length, while the center 20 and side stringers 60 are preferably about 48 inches in length. Both the stringers 20, 60 and baffles 18, 40 are approximately three inches deep. Various-sized louvers may be constructed to fit light fixture housings of differing size by varying the number of longitudinal stringers and transverse baffles that comprise the louver, along with their dimensions. In addition, one skilled in the art understands that the number of tubular lamps utilized may vary depending on the lighting performance desired or the size of the light fixture housing.

The stringers and baffles which comprise louver 14 are preferably made from a lightweight, ultra-thin metal, such as aluminum. The aluminum is preferably anodized, providing a finish that increases resistance to dents and scratches while virtually eliminating any visibility of fingerprints or construction dust. It should be recognized that any material possessing these or similar characteristics may also be used. In the event that a plastic material is chosen for the louver, however, the use of tubular fluorescent lamps as a light source is preferred, as both HID and incandescent lamps tend to generate substantial amounts of heat which can lead to deterioration of the louver.

Figure 4A:
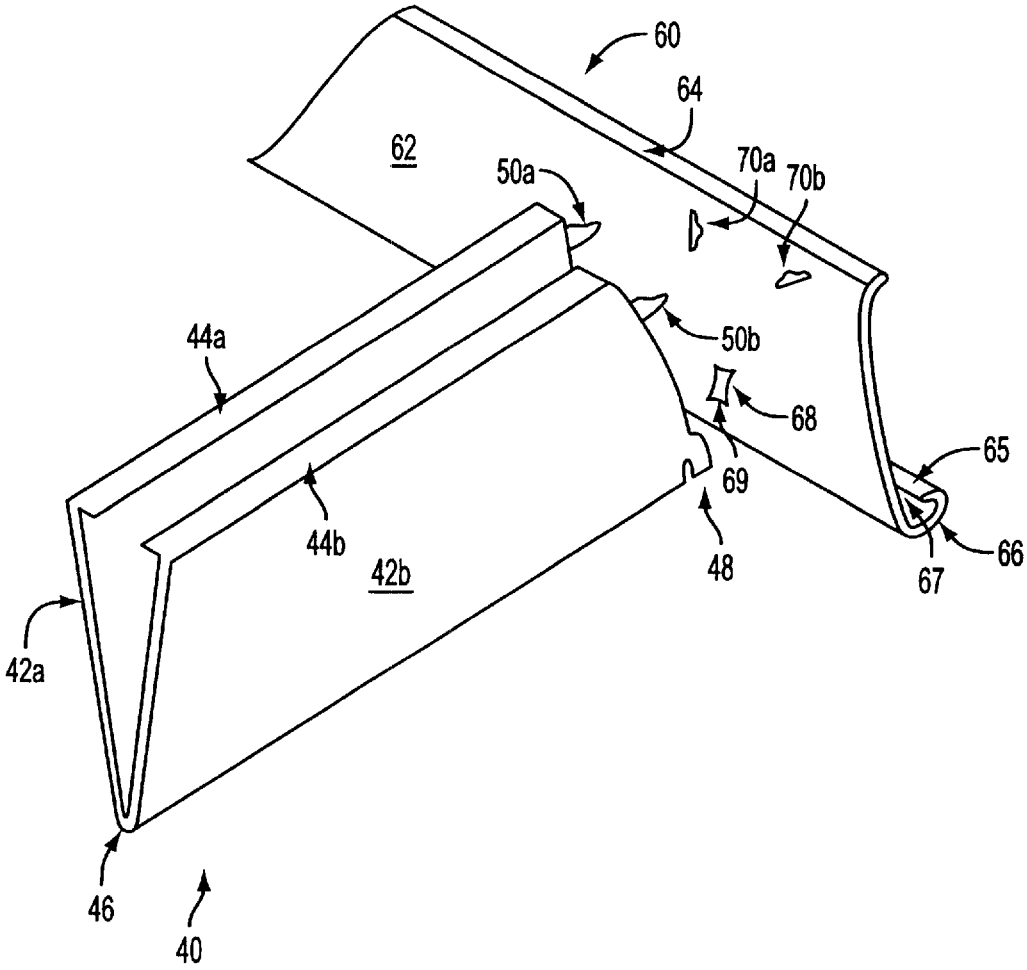
FIGS. 4*a*–4*b* are respective, partial perspective and side views illustrating how a center baffle and a side stringer are interconnected to form a side joint of a parabolic louver according to an embodiment of the invention.

Regardless of the material chosen, the center stringers 20 and center baffles 40 each have a generally "V-shaped" cross-section with parabolic side wall surfaces. As an example, center baffle 40 is illustrated in FIG. 4*a* having two parabolic side walls 42*a,* 42*b* that converge at a bottom edge 46. The side walls 42*a,* 42*b* extend upward from bottom edge 46, forming two inwardly extending upper surfaces 44*a,* 44*b* at their respective ends. These upper surfaces 44*a,* 44*b* are closest to the tubular lamps when the louver is mounted to a light fixture housing. The side walls 42*a,* 42*b* are parabolic in shape, so as to reflect the light emitted from the lamps downward, thus avoiding the escape of low angle light rays which result in glare. As seen in FIG. 2, the center stringers 20 also possess the same parabolic side walls and "V-shaped" cross-section.

Figure 4B:
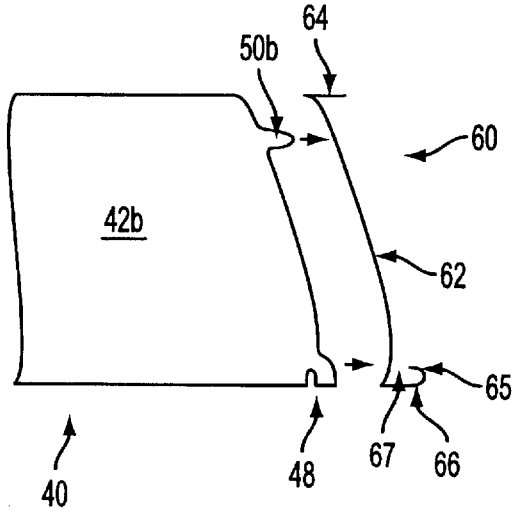

The outer periphery of the parabolic louver is defined by two side stringers 60 which extend in the longitudinal direction, and two end baffles 18 which extend in the transverse direction. Both the side stringers 60 and end baffles 18 possess the same basic design. As a representative example, FIGS. 4*a* and 4*b* illustrate, in part, a side stringer 60. The side stringer comprises a curved side wall 62 that extends upward from a base portion 66 and terminates in an upper edge 64. The base portion 66 contains a curved lip portion 65 which aids in defining a channel 67 that is positioned between the lip portion 65 and the side wall 62. The two end baffles 18, although similar in design to the side stringers 60, do not contain a curved lip portion. Channel 67 extends the entire length of side stringer 60, and it is utilized to both receive and secure the rails of a side light seal. The side light seal, which is used to prevent any "leakage" of light, is discussed in greater detail below.

Two novel joints are used to interlock the longitudinal stringers and transverse baffles together when assembling the louver. A side joint is used to secure the center baffles 40 to the side stringers 60, as well as to secure the center stringers 20 to the end baffles 18. A center joint, on the other hand, is used to secure the center baffles 40 to the center stringers 20.

Side Joint

FIGS. 4*a* and 4*b* illustrate the interconnection of one center baffle 40 and one side stringer 60 to form a side joint of the parabolic louver. A pair of tabs 50*a,* 50*b* extend outward from the respective upper edges of side walls 42*a,* 42*b* at each end of center baffle 40. A formed hook 48 is also formed at the bottom edge 46 of the center baffle 40 at each end. The tabs 50*a,* 50*b* respectively correspond to notches 70*a,* 70*b* in the side wall 62 of the side stringer 60. Similarly, the formed hook 48 of center baffle 40 is designed to engage the bottom edge 69 of a lower opening 68 disposed in side stringer 60.

In order to interconnect the two pieces, the formed hook 48 of the center baffle is first placed through the lower opening 68 in side stringer 60 where it is subsequently slid downward over bottom edge 69 and secured. Next, tabs 50*a,* 50*b* are slid through notches 70*a,* 70*b* respectively, and then folded ninety degrees inward towards one another to prevent them from sliding back through the notches. When the center baffle 40 and side stringer 60 are interconnected, the two upper surfaces 44*a,* 44*b* of center baffle 40 are aligned in the same plane, more or less, as the upper edge 64 of side stringer 60.

For ease of illustration, only one end of center baffle 40 has been shown having a formed hook 48 and tabs 50*a,* 50*b*. Similarly, only one set of notches 70*a,* 70*b* and one lower opening 68 have been shown in a portion of side stringer 60. It should be recognized that both ends of the center baffle 40 will contain a formed hook 48 and tabs 50*a,* 50*b,* while the side stringer 60 may contain a series of notches 70*a,* 70*b* and lower openings 68 at spaced intervals. The number of notches and openings will depend on the size of the parabolic louver, and in particular, the number of center baffles that will have to be connected to the side stringer.

Figure 5A:
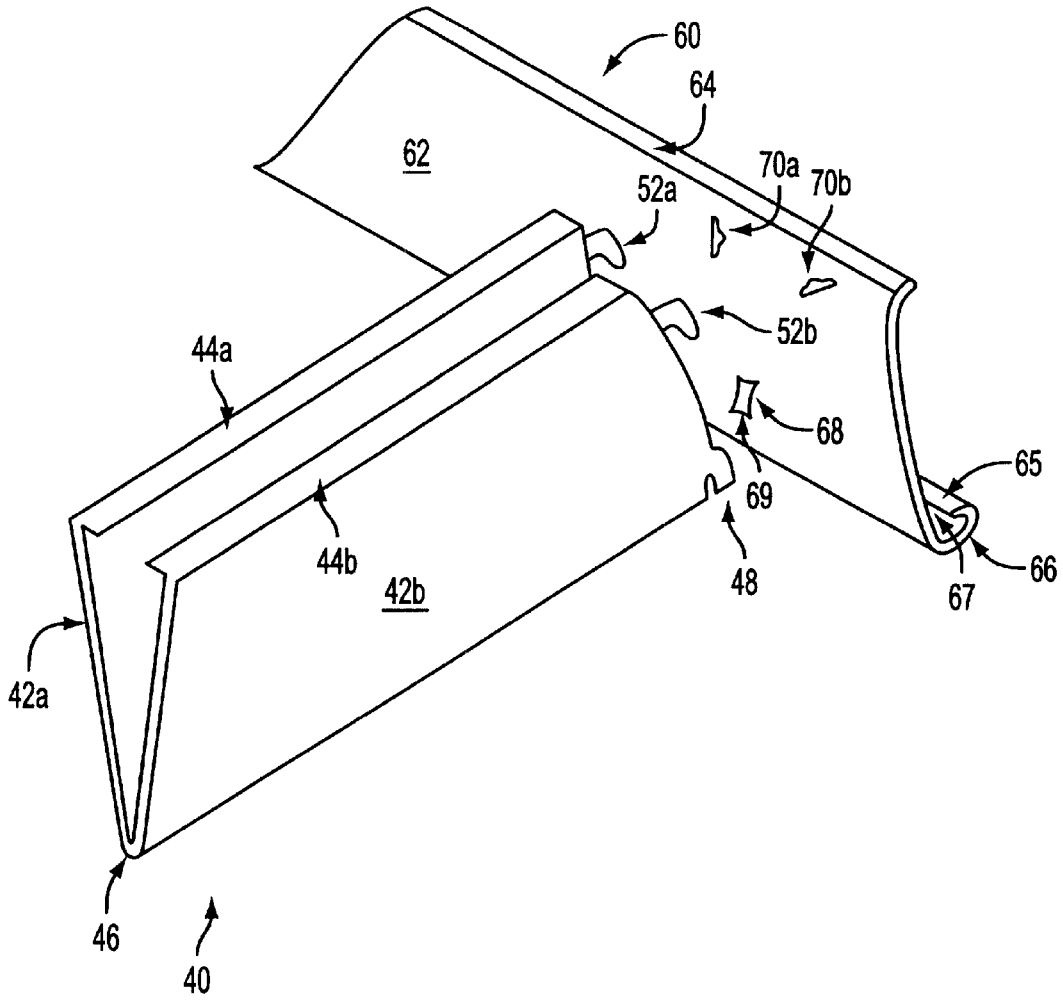
FIGS. 5*a*–5*b*are respective, partial perspective and side views illustrating how a center baffle and a side stringer are interconnected to form a side joint of a parabolic louver according to another embodiment of the invention.
Figure 5B:
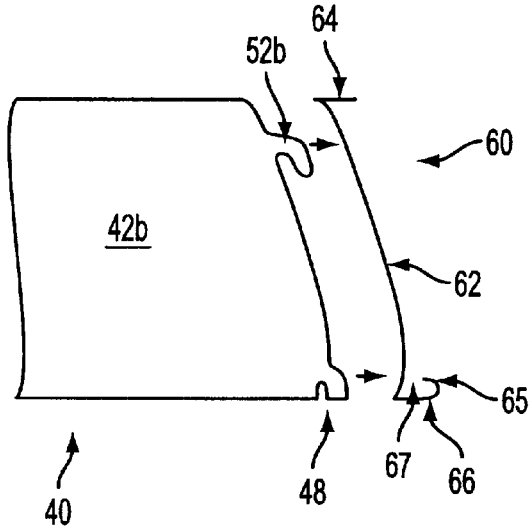

An alternative embodiment for forming a side joint of the parabolic louver is illustrated in FIGS. 5*a*–5*b*. In this embodiment, the tabs 50*a,* 50*b* on the ends of center baffle 40 are replaced with punched hooks 52*a,* 52*b* similar to the formed hook 48 formed at the bottom edge 46 of the center baffle 40. In order to connect the two pieces, the formed hook 48 of the center baffle is placed through the lower opening 68 in side stringer 60, while punched hooks 52*a,* 52*b* are slid through notches 70*a,* 70*b* respectively. Once all three hooks have been disposed through their respective openings or notches, the center baffle 40 may be slid downward allowing the three hooks to engage the bottom edges of their respective openings or notches, thus securing the two pieces together.

Each of the aforementioned embodiments are beneficial in their own regard. For example, a center baffle 40 having tabs 50*a,* 50*b,* as illustrated in FIGS. 4*a* and 4*b,* may be desirable from a manufacturing standpoint, as the tabs are relatively simple in design and easy to fabricate. However, the punched hooks 52*a,* 52*b* may also be desirable, as they eliminate the need to manually or robotically fold tabs upon assembly to prevent the center baffle and side stringer from becoming detached.

The foregoing description of the side joint of the parabolic louver was made in reference to the connection of a center baffle 40 to a side stringer 60. Although not illustrated, the same type of joint may be used to connect a center stringer 20 to an end baffle 18. A center stringer 20 may have three hooks for engagement with notches or openings in the end baffle 18. Alternatively, center stringer 20 may have one formed hook and two tabs at each end, for engagement with notches or openings in the end baffle 18. The notches or openings disposed in end baffle 18 would be similar to those described on side stringer 60.

Although not illustrated, the comer joints of the parabolic louver are formed where the respective ends of the end baffles 18 and side stringers 60 come together. Each end of the two end baffles 18 may contain two tabs extending from the respective top and bottom edges. These tabs are designed to fold-over the edges of the respective side stringers 60 aligned perpendicular thereto, and be received in corresponding slots formed in the side walls of the respective side stringers. Alternatively, a punched hook (similar to hooks 52*a,* 52*b*) may replace the tab extending from the top edge of each end of the end baffles 18. The punched hook would engage a corresponding notch formed in the side wall of the respective side stringer. A fold-over tab extending from the bottom edge of each end baffle would engage a corresponding slot formed in the side wall of the respective side stringer, as described above.

Center Joint

As previously mentioned, a novel center joint is used to secure the center baffles 40 to the center stringers 20 when assembling the parabolic louver. For ease of illustration, FIG. 6 shows only a partial section of one center baffle 40 and one center stringer 20.

Each side wall 42*a,* 42*b* of center baffle 40 is provided with a respective opening 45*a,* 45*b* therein. Side wall 42*a* has two punched hooks 56*a,* 57*a* that are mounted opposite one another, each on a respective side of opening 45*a*. In addition, a projection 58*a* is formed at the lower edge of opening 45*a*. Similarly, side wall 42*b* also has two punched hooks 56*b,* 57*b* mounted opposite one another, each on a respective side of opening 45*b*. Side wall 42*b* also contains a projection 58b that is not visible in FIG. 6.

Center stringer 20 is fabricated with a first aperture 35*a* in the upper portion of side wall 22*a*. The first aperture 35*a* contains two elongated slits 37*a,* 37*b*. A second aperture 35*b* is similarly formed in the upper portion of side wall 22*b,* also containing two elongated slits 36*a,* 36*b*. An elongated opening 34 extends upward from the bottom edge 29 of the center stringer, and is disposed in each side wall 22*a,* 22*b* of the center stringer 20.

Figure 6:
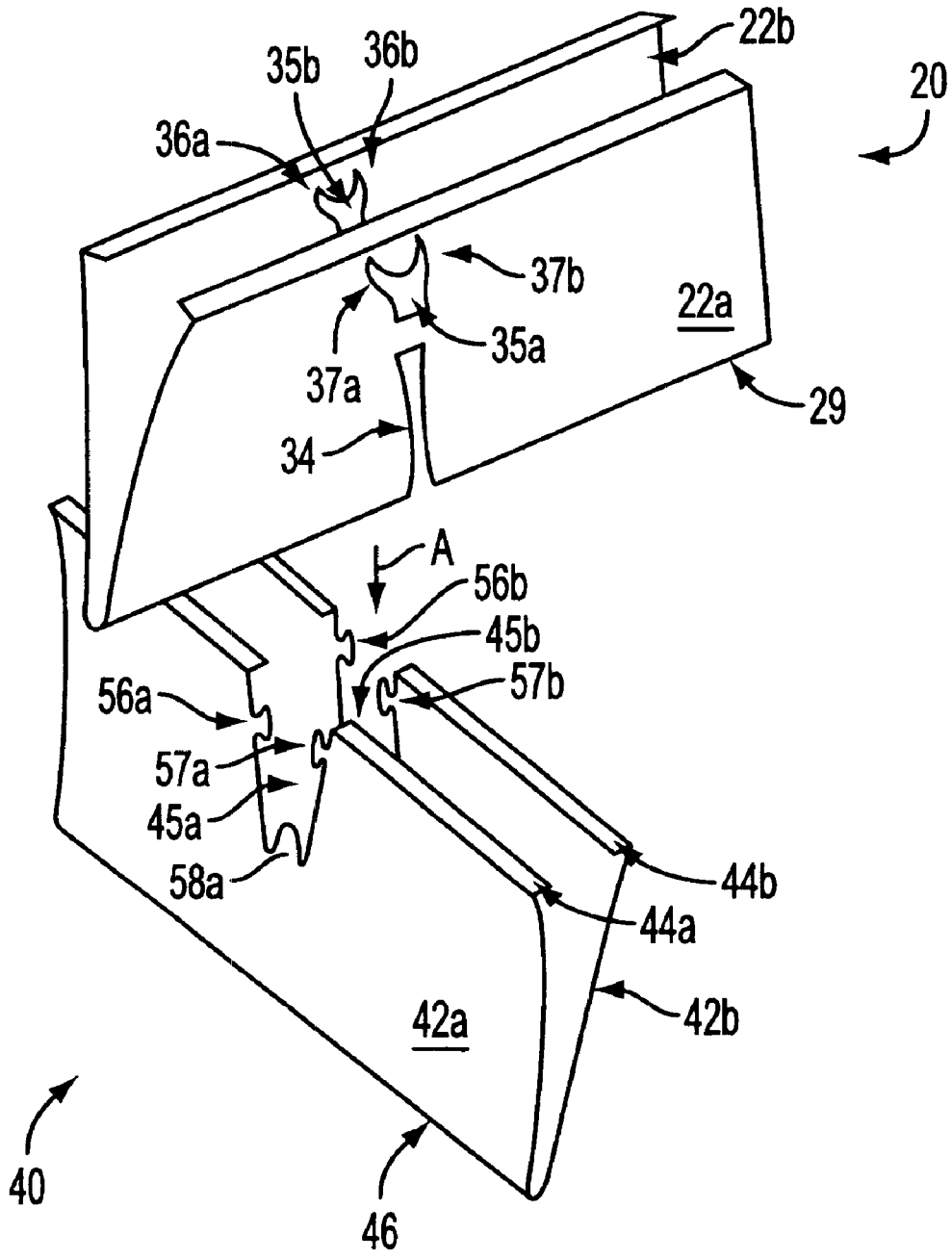
FIG. 6 is an exploded partially sectioned perspective view illustrating how a center baffle and center stringer are interconnected to form a center joint of a parabolic louver according to an embodiment of the invention.

To form the center joint, as seen in FIG. 6, center baffle 40 and center stringer 20 are aligned perpendicular to one another such that the elongated opening 34 of center stringer 20 is aligned with the openings 45*a,* 45*b* in the respective side walls of center baffle 40. As the center stringer is moved downward in the direction illustrated by arrow A, the two projections 58*a,* 58*b* on center baffle 40 are both received within the elongated opening 34 of the center stringer 20. To facilitate this, the side walls 42*a,* 42*b* of the center baffle may be squeezed together to ensure that the projections 58*a,* 58*b* fit within opening 34. To complete the assembly, the center stringer is slid further downward in the direction of arrow A. This allows the two punched hooks 56*a,* 56*b* on center baffle 40 to engage the two elongated slits 36*a,* 36*b* of the aperture 35*b* that is formed in the side wall 22*b* of center stringer 20. Likewise, the other pair of punched hooks 57*a,* 57*b* are designed to engage the two elongated slits 37*a,* 37*b* of aperture 35*a*.

Once assembled, the center stringer 20 and center baffle 40 remain securely interconnected. The design of the punched hooks mounted on the center baffle 40 contributes largely to this secure connection. The punched hooks 56*a,* 57*a* mounted on the side wall 42*a* of center baffle 40 each extend outward from the respective sides of opening 45*a*. Thus, a slight opening is created between each punched hook and the respective sides of opening 45*a*. Similarly, punched hooks 56*b,* 57*b* mounted on the side wall 42*b* of center baffle 40 each extend outward from the respective sides of opening 45*b*. Again, a slight opening is created between each punched hook and the respective sides of opening 45*b*. The width of these slight openings is equal to the thickness of the side walls 22*a,*22*b* of the center stringer 20. Accordingly, when punched hooks 56*a,* 56*b* engage elongated slits 36*a,* 36*b,* and punched hooks 57*a,* 57*b* engage elongated slits 37*a,* 37*b,* a tight and durable connection is achieved.

In order to release the connection, the side walls 22*a,* 22*b* of center stringer 20 have to be squeezed together, while simultaneously lifting the center stringer upward. By lifting the center stringer upward, the closed hooks are disengaged from their respective elongated slits.

Figure 7:
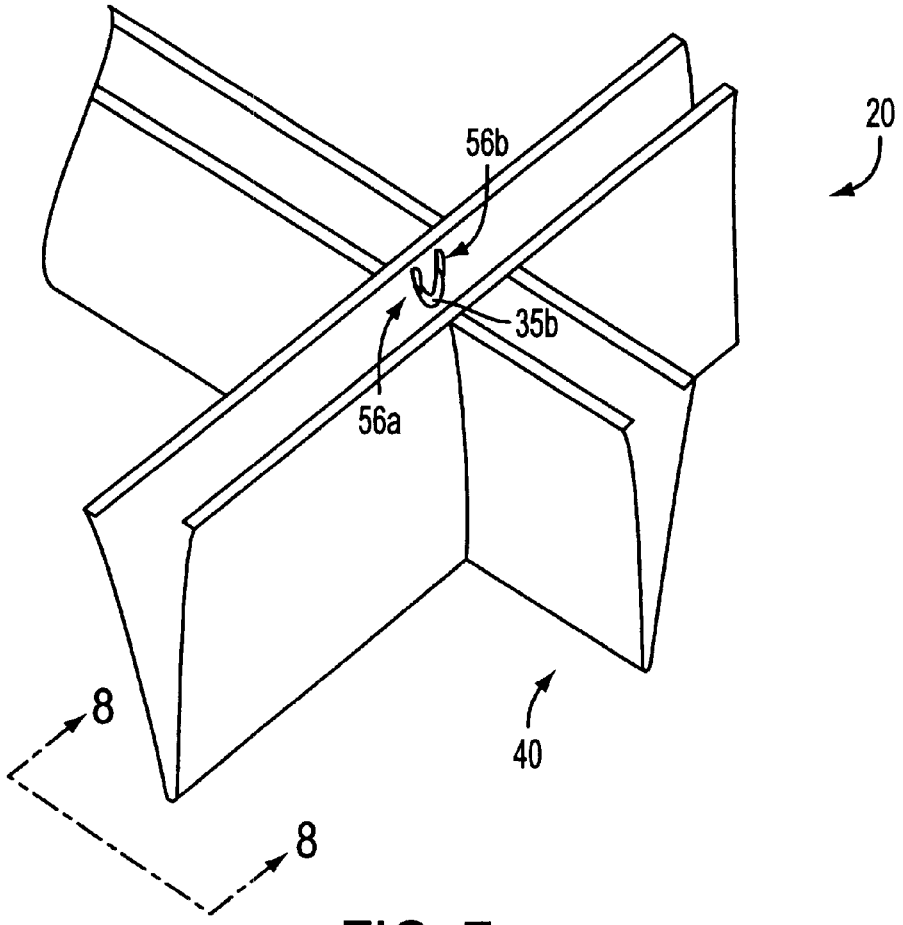
FIG. 7 is a partial perspective view of a center joint of a parabolic louver formed by interconnecting a center baffle and center stringer according to an embodiment of the invention.
Figure 8:
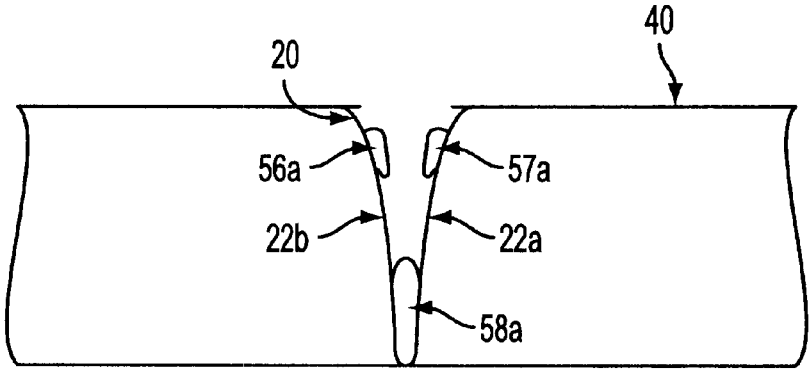
FIG. 8 is a sectional view of the center joint as taken along line 8-8 of FIG. 7.

FIGS. 7 and 8 illustrate different views of the center joint after assembly. FIG. 8, in particular, depicts punched hooks 56*a* and 57*a* of center baffle 40 secured through the respective side walls 22*b,* 22*a* of center stringer 20.

Side Light Seal

After the longitudinal stringers and transverse baffles have been interconnected via the novel side and center joints, a side light seal comprising two side rails and two end rails is added to the outer periphery of the parabolic louver in order to minimize the "leakage" of light from the peripheral edges of the louver. In particular, the two side rails of the side light seal are mounted directly to the two side stringers 60 of the louver 14. The two end rails, however, do not engage the two end baffles 18 of the louver 14. They are maintained in position via their interconnection with the two end rails of the side light seal.

If desired, the parabolic louver may be mounted to a light fixture housing absent a side light seal. This is not preferred, however, as the inclusion of the side light seal prevents light rays from escaping in the space between the light fixture housing and parabolic louver.

Figure 9A:
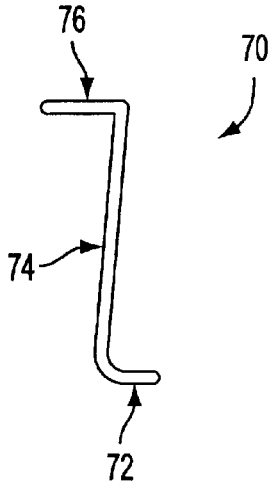
FIGS. 9*a*–9*b*are respective front and perspective views of one rail of a side light seal for use with a parabolic louver according to an embodiment of the invention.
Figure 9B:
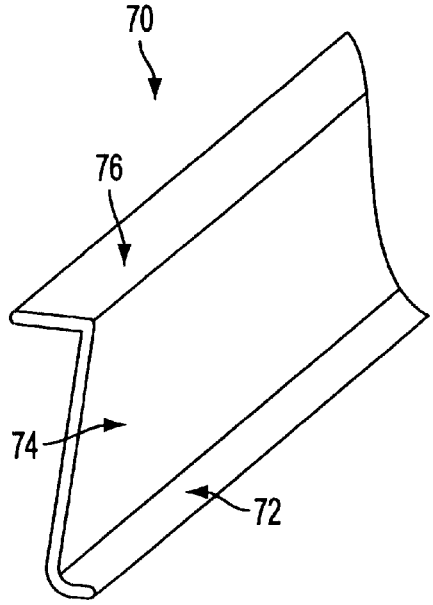

FIGS. 9*a* and 9*b* illustrate one of two side rails 70 of the side light seal. The two side rails, preferably made from steel, are substantially identical in cross-section and have a "z-shaped" cross-section. Rails 70 comprise a side wall 74 that extends between a bottom lip 72 and an upper lip 76.

The novel design of the side stringers 60 facilitate the attachment of the two side rails 70 to the side stringers of the parabolic louver.

Figure 10:
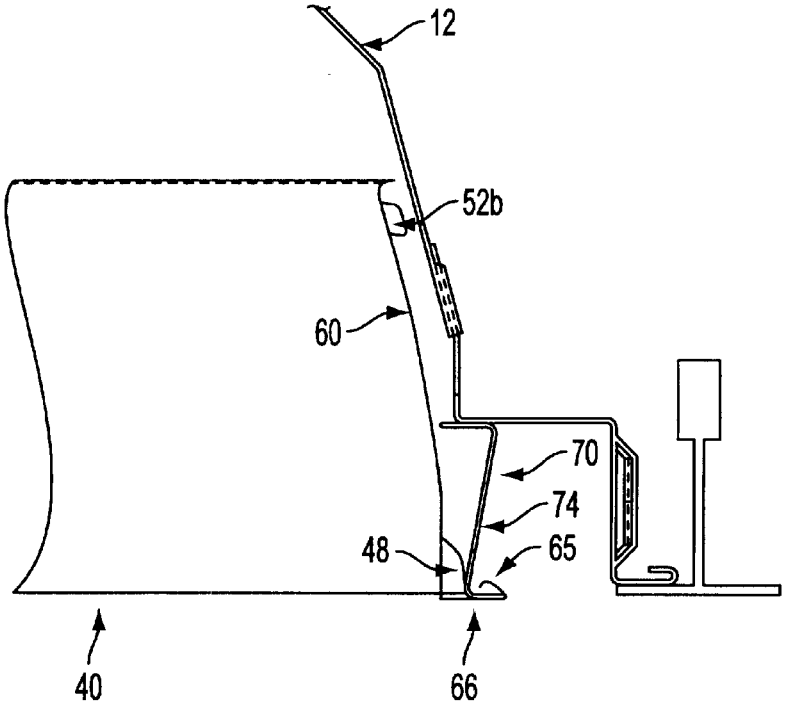
FIG. 10 is a partial front view illustrating how a parabolic louver, a side light seal rail, and a light fixture housing are interconnected according to an embodiment of the invention.

With reference to FIG. 10, light fixture housing 12 is shown together with one side rail 70, and a side joint connecting center baffle 40 to side stringer 60. Center baffle 40 and side stringer 60 are interconnected via three hooks as previously disclosed and illustrated in FIGS. 5*a*–5*b*. Side stringer 60 has a base portion 66 which contains a curved lip portion 65. The curved lip portion 65 defines one portion of a channel 67 (seen in FIGS. 4*a* and 5*a*) that extends between the lip portion 65 and the side wall of side stringer 60. The bottom lip 72 of rail 70 sits in channel 67, and the side wall 74 of rail 70 abuts against formed hook 48. The curved lip portion 65 overlaps the bottom lip 72 of the rail, which aids in holding the rail in place and holding the louver 14 in the fixture housing 12.

Figure 11A:
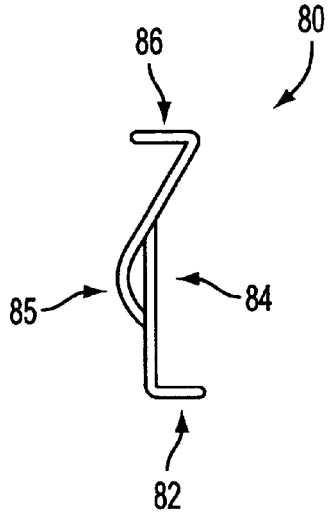
FIGS. 11*a*–11*b* are respective front and perspective views of a side light seal rail for use with a parabolic louver according to an embodiment of the invention.
Figure 11B:
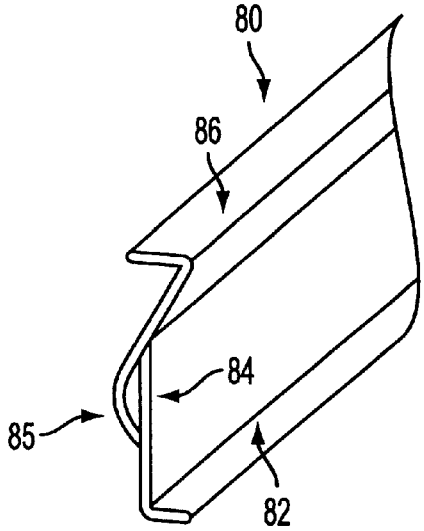
Figure 12:
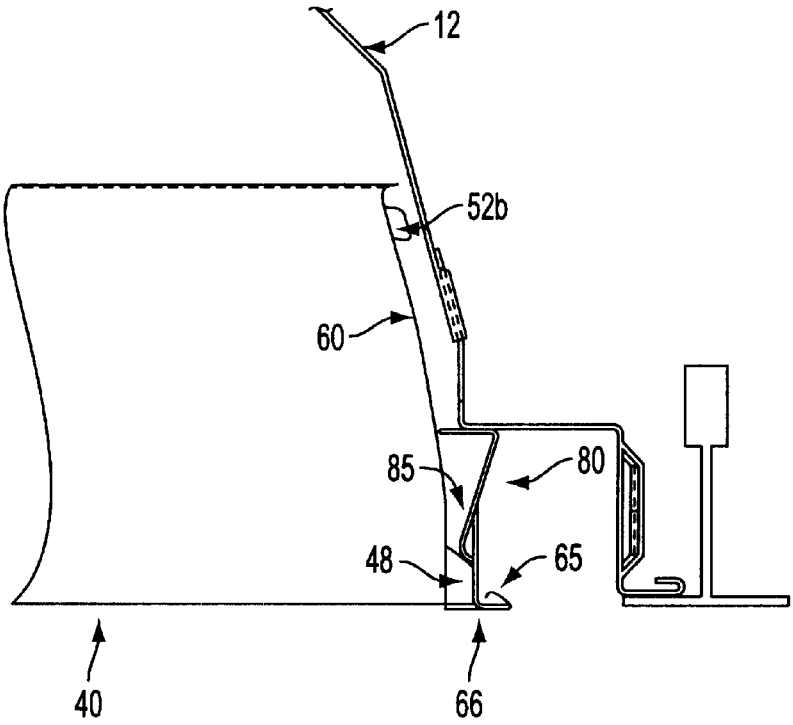
FIG. 12 is a partial front view illustrating how the side light seal rail illustrated in FIGS. 11*a*–11*b* is interconnected with a parabolic louver and a light fixture housing according to another embodiment of the invention.

An alternative design for a light side seal side rail is illustrated in FIGS. 11*a*–11*b*. In this embodiment, side rail 80 comprises a side wall 84 that extends between a bottom lip 82 and an upper lip 86. As best seen in FIG. 12, an emboss 85 protrudes outward from side wall 84 and extends over the top of formed hook 48 to keep the center baffle 40 and center stringer 60 from sliding apart. Additionally, as described in the previous embodiment, the curved lip portion 65 of center stringer 60 overlaps the bottom lip 82 of rail

80, to help hold the rail in place. As illustrated in FIG. 11*b*, emboss 85 extends the entire length of the side rail 80. In an alternative embodiment, a series of individual embosses may extend over each formed hook 48 at each point where a center baffle 40 engages side stringer 60.

Figure 13:
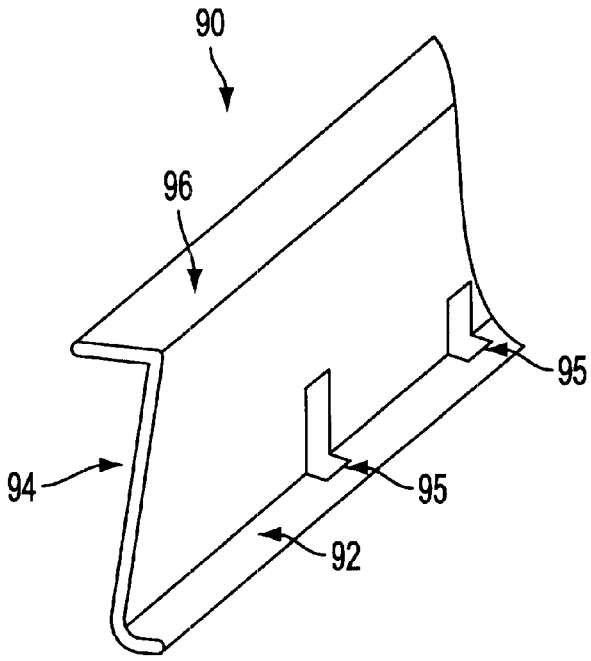
FIG. 13 is a perspective view of a side light seal rail for use with a parabolic louver according to another embodiment of the invention.
Figure 14:
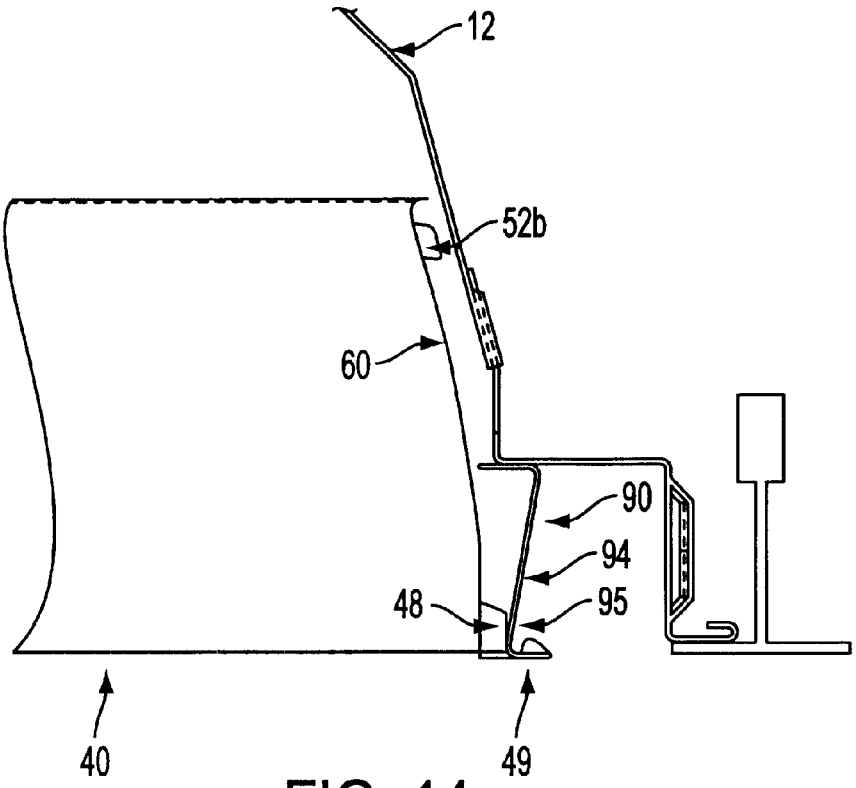
FIG. 14 is a partial front view illustrating how the side light seal rail illustrated in FIG. 13 is interconnected with a parabolic louver and a light fixture housing, according to another embodiment of the invention.

FIGS. 13-14 illustrate yet another embodiment in which a side rail of a side light seal may be secured to the side stringer of a parabolic louver. In this embodiment, formed hook 48 (which extends from the bottom edge of center baffle 40) is fabricated with a notched extension 49. A side rail 90 having a "z-shaped" cross-section comprises a side wall 94 that extends from bottom lip 92 to upper lip 96. The side rail 90 also includes a series of open slots 95 that are integrally formed along the bend where bottom lip 92 and side wall 94 meet. When rail 90 is placed into channel 67, the open slot 95 engages notched extension 49, effectively preventing the center baffle 40 and side stringer 60 from sliding apart. The number of open slots 95 that are pierced in a particular side light seal rail 90 is dependent upon the size of the parabolic louver, and in particular, on the number of center baffles that will have to be connected to the side stringer 60. In other words, for each center baffle 40 having a formed hook 48 with a notched extension 49, a corresponding open slot 95 in rail 90 is needed.

As is known in the art, the various side light seal configurations disclosed herein will contain fastening components designed to releasably mount both the louver and the light side seal to a light fixture housing or troffer.

Other embodiments, uses and advantages of the invention will be apparent to those skilled in the art from consideration of the specification and practice of the invention disclosed herein. The specification should be considered exemplary only, and the scope of the invention is accordingly intended to be limited only to the following claims.

We claim:

1. A parabolic louver and side light seal for use in a light fixture housing having at least one tubular light source, wherein said parabolic louver comprises:

(a) at least one center stringer extending in a longitudinal direction and at least one center baffle extending in a transverse direction, wherein said at least one center stringer and center baffle each comprise two parabolic side walls;

(b) two side stringers and two end baffles defining an outer perimeter of said parabolic louver;

(c) a center joint for interconnecting said at least one center stringer and said at least one center baffle;

(d) a side joint for interconnecting said at least one center stringer to said two end baffles, and said at least one center baffle to said two side stringers, said side joint of at least said center baffle being characterized by a formed hook and one or more protrusions extending outward from lower and upper portions, respectively, of said parabolic side walls at ends thereof;

wherein said side light seal comprises two side rails, with said two side rails being mounted to the two side stringers of said parabolic louver, each of said two side rails further comprising a side wall extending between a bottom lip and an upper lip, said bottom lip and said upper lip being disposed on opposite sides of said side wall;

wherein said side stringers and end baffles each comprise a curved side wall extending upward from a base portion and terminating in an upper edge, said base portion and said upper edge being disposed on the same side of said curved side wall and extending parallel to one another;

wherein said base portion of said side stringer further comprises a curved lip portion extending inward toward said curved side wall to form a channel;

wherein said channel is adapted to receive the bottom lip of one of said side rails of said side light seal; and wherein each of said side rails of said side light seal comprises an emboss protruding outward from said side wall that is adapted to extend over said formed hooks when said at least one center baffle is interconnected to each of said two side stringers.

2. A parabolic louver and side light seal for use in a light fixture housing having at least one tubular light source, wherein said parabolic louver comprises:

(a) at least one center stringer extending in a longitudinal direction and at least one center baffle extending in a transverse direction, wherein said at least one center stringer and center baffle each comprise two parabolic side walls;

(b) two side stringers and two end baffles defining an outer perimeter of said parabolic louver;

(c) a center joint for interconnecting said at least one center stringer and said at least one center baffle;

(d) a side joint for interconnecting said at least one center stringer to said two end baffles, and said at least one center baffle to said two side stringers, said side joint of at least said center baffle being characterized by a formed hook and one or more protrusions extending outward from lower and upper portions, respectively, of said parabolic side walls at ends thereof;

wherein said side light seal comprises two side rails, with said two side rails being mounted to the two side stringers of said parabolic louver, each of said two side rails further comprising a side wall extending between a bottom lip and an upper lip, said bottom lip and said upper lip being disposed on opposite sides of said side wall;

wherein said side stringers and end baffles each comprise a curved side wall extending upward from a base portion and terminating in an upper edge, said base portion and said upper edge being disposed on the same side of said curved side wall and extending parallel to one another;

wherein said base portion of said side stringer further comprises a curved lip portion extending inward toward said curved side wall to form a channel;

wherein said formed hook further comprises a notched extension.

3. The parabolic louver and side light seal combination of claim 2, wherein each of said side rails of said side light seal further comprises at least one open slot integrally formed at a point where the bottom lip and the side wall of the side rail intersect.

4. The parabolic louver and side light seal combination of claim 3, wherein said notched extension is disposed within said at least one open slot to secure said side rail of said side light seal to said end baffle, when said at least one center baffle is interconnected to each of said two side stringers.

5. A parabolic louver and light seal combination for use in a light fixture housing having at least one tubular light source, comprising:

(a) two or more center blades forming a parabolic louver, at least two of said blades being perpendicular to one another such that one or more of said blades extends in a longitudinal direction and one or more of said blades extends in a transverse direction;

(b) four or more peripheral blades forming a periphery of said parabolic louver, at least one of said peripheral blades having a base portion extending outwardly from said periphery and a curved side extending upward from said base portion to thereby form a channel;

(c) wherein at least one of said center blades is connected to at least one of said peripheral blades by a side joint, said side joint comprising:

(i) a formed hook extending outward from a lower portion of said center blade, the formed hook designed to engage a bottom edge of a lower opening formed in said peripheral blade (ii) one or more protrusions extending outward from an upper portion of said center blade, the one or more protrusions adapted to be disposed through corresponding notches formed in said peripheral blade; and (e) one or more light seals, each light seal comprising a bottom lip, an upper lip and a side wall therebetween, said bottom lip and said upper lip being disposed on opposite sides of said side wall;

wherein said bottom lip is positioned within said channel and abuts said formed hook, thereby holding said light seal and said center blade in place; and wherein said formed hook further comprises a notched extension.

6. The parabolic louver and side light seal combination of claim 5, wherein said one or more light seals further comprises at least one open slot integrally formed at a point where the bottom lip and the side wall of the light seal intersect.

7. The parabolic louver and side light seal combination of claim 6, wherein said notched extension is disposed within said at least one open slot to hold said center blade in place.

8. A parabolic louver and light seal combination for use in a light fixture housing having at least one tubular light source, comprising:

(a) two or more center blades forming a parabolic louver, at least two of said blades being perpendicular to one another such that one or more of said blades extends in a longitudinal direction and one or more of said blades extends in a transverse direction;

(b) four or more peripheral blades forming a periphery of said parabolic louver, at least one of said peripheral blades having a base portion extending outwardly from said periphery and a curved side extending upward from said base portion to thereby form a channel;

(c) wherein at least one of said center blades is connected to at least one of said peripheral blades by a side joint, said side joint comprising:

(i) a formed hook extending outward from a lower portion of said center blade, the formed hook designed to engage a bottom edge of a lower opening formed in said peripheral blade (ii) one or more protrusions extending outward from an upper portion of said center blade, the one or more protrusions adapted to be disposed through corresponding notches formed in said peripheral blade; and (e) one or more light seals, each light seal comprising a bottom lip, an upper lip and a side wall therebetween, said bottom lip and said upper lip being disposed on opposite sides of said side wall;

wherein said bottom lip is positioned within said channel and abuts said formed hook, thereby holding said light seal and said center blade in place; and wherein said one or more light seals further comprises at least one emboss protruding outward from said side wall, said emboss being adapted to extend over said formed hook open to hold said center blade in place.

9. A parabolic louver and side light seal for use in a light fixture housing having at least one tubular light source, wherein said parabolic louver and side light seal comprises:

(a) at least one side light seal comprising a bottom lip, an upper lip and a side wall therebetween, said bottom lip and said upper lip being disposed on opposite sides of said side wall;

(b) at least one center stringer extending in a longitudinal direction and at least one center baffle extending in a transverse direction, wherein said at least one center stringer and center baffle each comprise two parabolic side walls;

(c) two side stringers and two end baffles defining an outer perimeter of said parabolic louver, said side stringers and end baffles each comprising a curved side wall extending upward from a base portion and terminating in an upper edge, said base portion and said upper edge being disposed on the same side of said curved side wall and extending parallel to one another, and at least one of said side stringers further comprising a curved lip portion extending inward from an outer edge of said base portion to form a channel;

(d) a center joint for interconnecting said at least one center stringer and said at least one center baffle; and (e) a side joint for interconnecting said at least one center baffle to said two side stringers, said side joint being characterized by a formed hook and one or more protrusions extending outward from lower and upper portions, respectively, of said parabolic side walls at ends thereof, said formed hook being designed to engage a bottom edge of a lower opening formed in at least one of said two side stringers; and said protrusions being adapted to be disposed through a corresponding one or more notches formed in at least one of said two side stringers;

wherein said channel is adapted to receive said bottom lip; and wherein at least one of said side light seals further comprises an emboss protruding outward from said side wall, said emboss being adapted to extend over said formed hook when said at least one center baffle is interconnected to each of said two side stringers.

10. The parabolic louver and side light seal combination of claim 9, wherein said at least one center stringer, said at least one center baffle, said two side stringers, and said two end baffles are all formed from lightweight, ultra-thin, anodized aluminum.

11. The parabolic louver and side light seal combination of claim 9, wherein the two side rails of said side light seal are formed from steel.

12. The parabolic louver and side light seal combination of claim 9, wherein said parabolic side walls of said at least one center stringer and said at least one center baffle each extend upward from a converging bottom edge, with each parabolic side wall terminating in an inwardly extending upper surface.

13. The parabolic louver and side light seal combination of claim 12, wherein an opening is disposed in each parabolic side wall of said at least one center baffle; each respective opening comprising:

(a) a pair of punched hooks disposed opposite one another on respective sides of said opening; and (b) a projection formed at a lower edge of said opening.

14. The parabolic louver and side light seal combination of claim 13, wherein said at least one center stringer further comprises:

(a) an elongated opening extending upward from said converging bottom edge, said elongated opening being formed in both parabolic side walls; and (b) an aperture formed in an upper portion of each respective parabolic side wall, wherein each aperture respectively includes two elongated slits.

15. The parabolic louver and side light seal combination of claim 14, wherein said center joint is characterized by the converging bottom edge of said at least one center stringer being slid downward through the opening in each of the parabolic side walls of said at least one center baffle, such that:

(a) each of the respective projections formed at the lower edges of each opening of said at least one center baffle are received in the elongated opening of said at least one center stringer; and (b) each pair of punched hooks disposed opposite one another on respective sides of each opening of said at least one center baffle engage the elongated slits of the apertures formed in each respective parabolic side wall of said at least one center stringer.

16. The parabolic louver and side light seal combination of claim 9, wherein said one or more protrusions comprise tabs that are disposed through said corresponding one or more notches and folded inward to prevent said tabs from withdrawing from said corresponding one or more notches.

17. The parabolic louver and side light seal combination of claim 9, wherein said one or more protrusions comprise punched hooks.

18. The parabolic louver and side light seal combination of claim 9, wherein said formed hook further comprises a notched extension.

19. The parabolic louver and side light seal combination of claim 18, wherein said at least one side light seal further comprises at least one open slot integrally formed at a point where the bottom lip and the side wall intersect.

20. The parabolic louver and side light seal combination of claim 19, wherein said notched extension is disposed within said at least one open slot to secure said side rail of said side light seal to said end baffle, when said at least one center baffle is interconnected to each of said two side stringers.

* * * * *